US011106171B2

(12) United States Patent
Imaizumi et al.

(10) Patent No.: US 11,106,171 B2
(45) Date of Patent: Aug. 31, 2021

(54) IMAGE FORMING APPARATUS THAT INCREASES A SHEET FEEDING INTERVAL WHEN OBLIQUE SHEET MOVEMENT IS DETECTED

(71) Applicant: CANON KABUSHIKI KAISHA, Tokyo (JP)

(72) Inventors: Toru Imaizumi, Kawasaki (JP); Hikaru Osada, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/193,448

(22) Filed: Nov. 16, 2018

(65) Prior Publication Data

US 2019/0155202 A1 May 23, 2019

(30) Foreign Application Priority Data

Nov. 21, 2017 (JP) ..... JP2017-223308

(51) Int. Cl.
*G03G 15/00* (2006.01)
*G03G 15/20* (2006.01)

(52) U.S. Cl.
CPC ..... *G03G 15/6567* (2013.01); *G03G 15/2028* (2013.01); *G03G 15/5041* (2013.01); (Continued)

(58) Field of Classification Search
CPC ..... G03G 15/6567; G03G 15/2028; G03G 15/5041; G03G 15/5062; G03G 15/6564; G03G 15/6573; G03G 2215/00561
See application file for complete search history.

(56) References Cited

U.S. PATENT DOCUMENTS

2006/0062610 A1 3/2006 Ito et al. ..... 399/328
2007/0104502 A1 5/2007 Ogihara et al. ..... 399/66
(Continued)

FOREIGN PATENT DOCUMENTS

CN 1755550 4/2006
CN 1963680 5/2007
(Continued)

OTHER PUBLICATIONS

Office Action dated Jun. 21, 2021 in counterpart Chinese Application No. 201811371622.X, together with English translation thereof.

*Primary Examiner* — Joseph S Wong
(74) *Attorney, Agent, or Firm* — Venable LLP

(57) ABSTRACT

An image forming apparatus for forming an image on a recording material. The image forming apparatus includes an image forming portion, a fixing portion, an oblique movement detecting portion, and a controller. The image forming portion is configured to form the image on the recording material. The fixing portion includes a flexible cylindrical rotatable member and a roller in press contact with the rotatable member. The rotatable member and the roller are configured to form a fixing nip, in which the recording material, on which the image is formed, is nipped and fed. The oblique movement detecting portion is configured to detect oblique movement of the recording material. When the oblique movement detecting portion detects the oblique movement of the recording material, the controller increases a feeding interval of the recording material to the image forming portion.

15 Claims, 8 Drawing Sheets

(52) U.S. Cl.
CPC ..... *G03G 15/5062* (2013.01); *G03G 15/6564* (2013.01); *G03G 15/6573* (2013.01); *G03G 2215/00561* (2013.01)

(56) References Cited

U.S. PATENT DOCUMENTS

| | | | | |
|---|---|---|---|---|
| 2015/0063846 | A1 | 3/2015 | Fukai | 399/45 |
| 2015/0362865 | A1* | 12/2015 | Lee | G03G 15/14 399/395 |
| 2016/0223974 | A1* | 8/2016 | Shida | G03G 15/2039 |

FOREIGN PATENT DOCUMENTS

| | | | | |
|---|---|---|---|---|
| CN | 104423231 | | 3/2015 | |
| JP | H07-112849 | B2 | 12/1995 | |
| JP | 2006-208823 | A | 8/2006 | |
| JP | 2007-047555 | A | 2/2007 | |
| JP | 2012-163809 | A | 8/2012 | |
| JP | 2013018653 | A * | 1/2013 | B65H 85/00 |

* cited by examiner

IMAGE FORMING APPARATUS THAT INCREASES A SHEET FEEDING INTERVAL WHEN OBLIQUE SHEET MOVEMENT IS DETECTED

CROSS-REFERENCE TO RELATED APPLICATION

This application claims the benefit of Japanese Patent Application No. 2017-223308 filed on Nov. 21, 2017, which is hereby incorporated by reference herein in its entirety.

FIELD OF THE INVENTION AND RELATED ART

The present invention relates to an image forming apparatus such as an electrophotographic copying machine or an electrophotographic printer.

The electrophotographic printer includes an image forming portion for forming an image on a recording material, a fixing portion (fixing device) for fixing the image on the recording material, and a roller pair (discharging member) for discharging the recording material fed from the fixing portion by nipping and feeding the recording material through a nip.

The image forming portion includes a photosensitive drum for carrying the image and a transfer member for forming a transfer nip, in which the recording material is nipped and fed, in cooperation with the photosensitive drum and for transferring the image from the photosensitive drum onto the recording material. The fixing portion includes a rotatable member such as a cylindrical film or a roller, a rotatable pressing member, such as a roller or a cylindrical film, for forming a nip in which the image-formed recording material is nipped and fed, in contact with the rotatable member, and a heater for heating the image-formed recording material in the nip. The recording material on which an unfixed toner image is carried is heated while being nipped and fed through the nip, whereby the toner image is fixed on the recording material.

When the printer is downsized, a recording material feeding path is shortened, so that the case when a single recording material is nipped simultaneously by the nip of the fixing portion and the nip of the rollers occurs. When the single recording material is nipped simultaneously by the two nips provided at two positions, there is a tendency that a shifting force for shifting the film in a longitudinal direction perpendicular to a recording material feeding direction increases during feeding of the recording material. Particularly, when recording materials are continuously fed in a state in which the recording materials obliquely move leads to an increase in shifting force of the film, so that there is a possibility of an occurrence of a film shift such that the film is shifted in the longitudinal direction perpendicular to the recording material feeding direction. In order to suppress the film shift, a countermeasure may need to be taken such that oblique movement of the recording material is detected and then a film shifting force is relaxed.

As a method of detecting the oblique movement of the recording material, Japanese Laid-Open Patent Application (JP-A) Hei 7-112849 proposes a method in which sensors are provided inside both ends of a recording material passing region with respect to a longitudinal direction perpendicular to a recording material feeding direction and oblique movement is discriminated depending on a difference in detection time between leading ends of recording materials with respect to the recording material feeding direction.

When this method is used, although the oblique movement of the recording material can be detected, the film shifting force cannot be relaxed.

SUMMARY OF THE INVENTION

A principal object of the present invention is to provide an image forming apparatus capable of relaxing a shifting force of shifting a cylindrical rotatable member of a fixing portion.

According to one aspect, the present invention provides an image forming apparatus for forming an image on a recording material. The image forming apparatus includes an image forming portion, a fixing portion, an oblique movement detecting portion, and a control portion. The image forming portion is configured to form the image on the recording material. The fixing portion includes a flexible cylindrical rotatable member and a roller in press contact with the rotatable member. The rotatable member and the roller are configured to form a fixing nip, in which the recording material, on which the image is formed, is nipped and fed. The fixing portion is configured to fix the image on the recording material. The detecting portion is configured to detect oblique movement of the recording material. When the oblique movement detecting portion detects the oblique movement of the recording material, the control portion increases a feeding interval of the recording material to the image forming portion.

According to another aspect the present invention provides an image forming apparatus for forming an image on a recording material. The image forming apparatus includes an image forming portion, a fixing portion, a pressure releasing mechanism, an oblique movement detecting portion, and a control portion. The image forming portion is configured to form the image on the recording material. The fixing portion includes a flexible cylindrical rotatable member and a roller in press contact with the rotatable member. The rotatable member and the roller are configured to form a fixing nip, in which the recording material, on which the image is formed, is nipped and fed. The fixing portion is configured to fix the image on the recording material. The pressure releasing mechanism is configured to release pressure exerted on the fixing nip. The oblique movement detecting portion is configured to detect oblique movement of the recording material. When the oblique movement detecting portion detects the oblique movement of the recording material, the control portion controls the pressure releasing mechanism so as to execute an operation for lowering the pressure exerted on the fixing nip.

Further features of the present invention will become apparent from the following description of exemplary embodiments with reference to the attached drawings.

Figure 5:
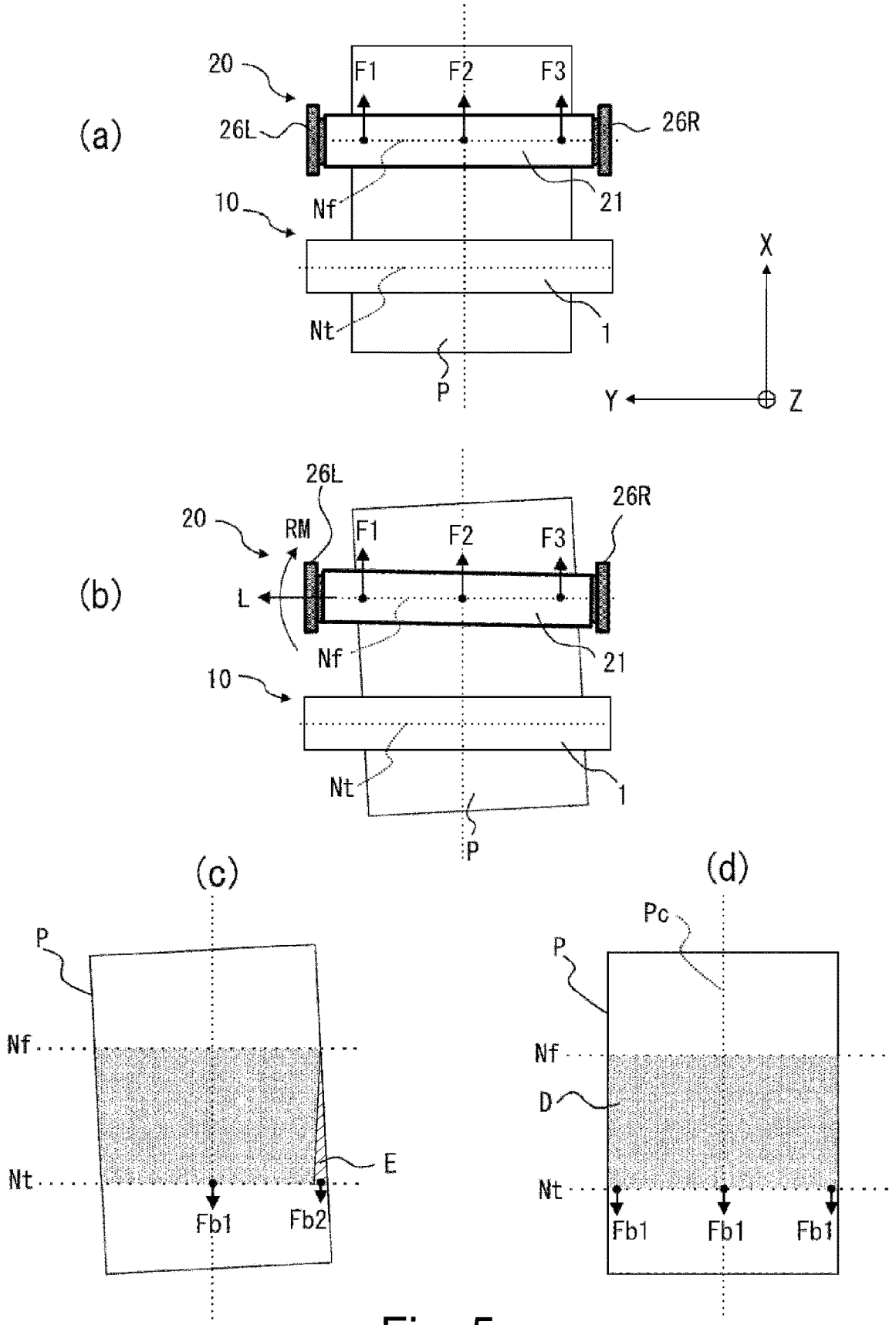

Parts (a), (b), (c), and (d) of FIG. 5 are schematic views for illustrating a generating mechanism of a film shift.

Figure 6:
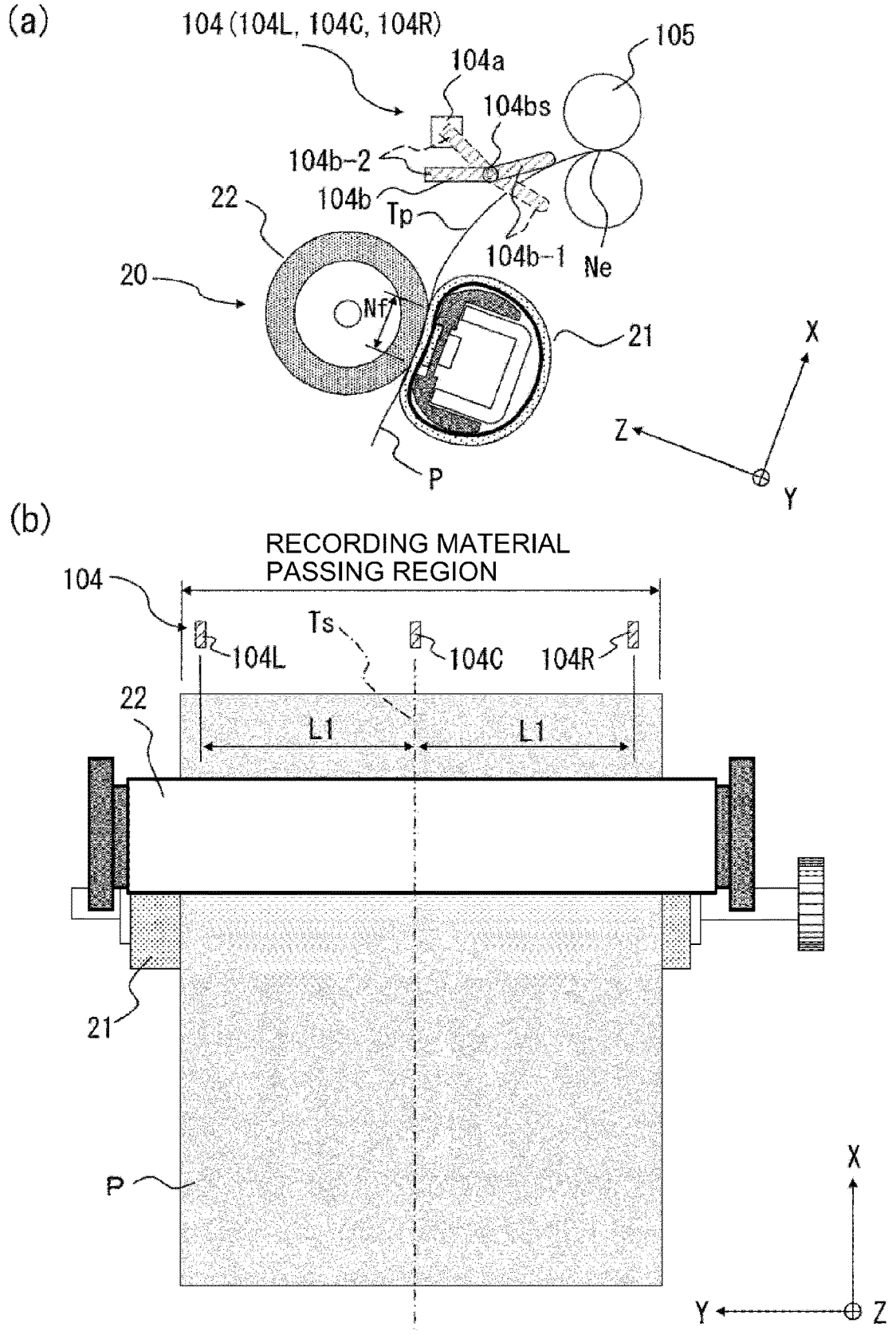

Parts (a) and (b) of FIG. 6 are schematic views for illustrating oblique movement detecting sensors.

Figure 7:
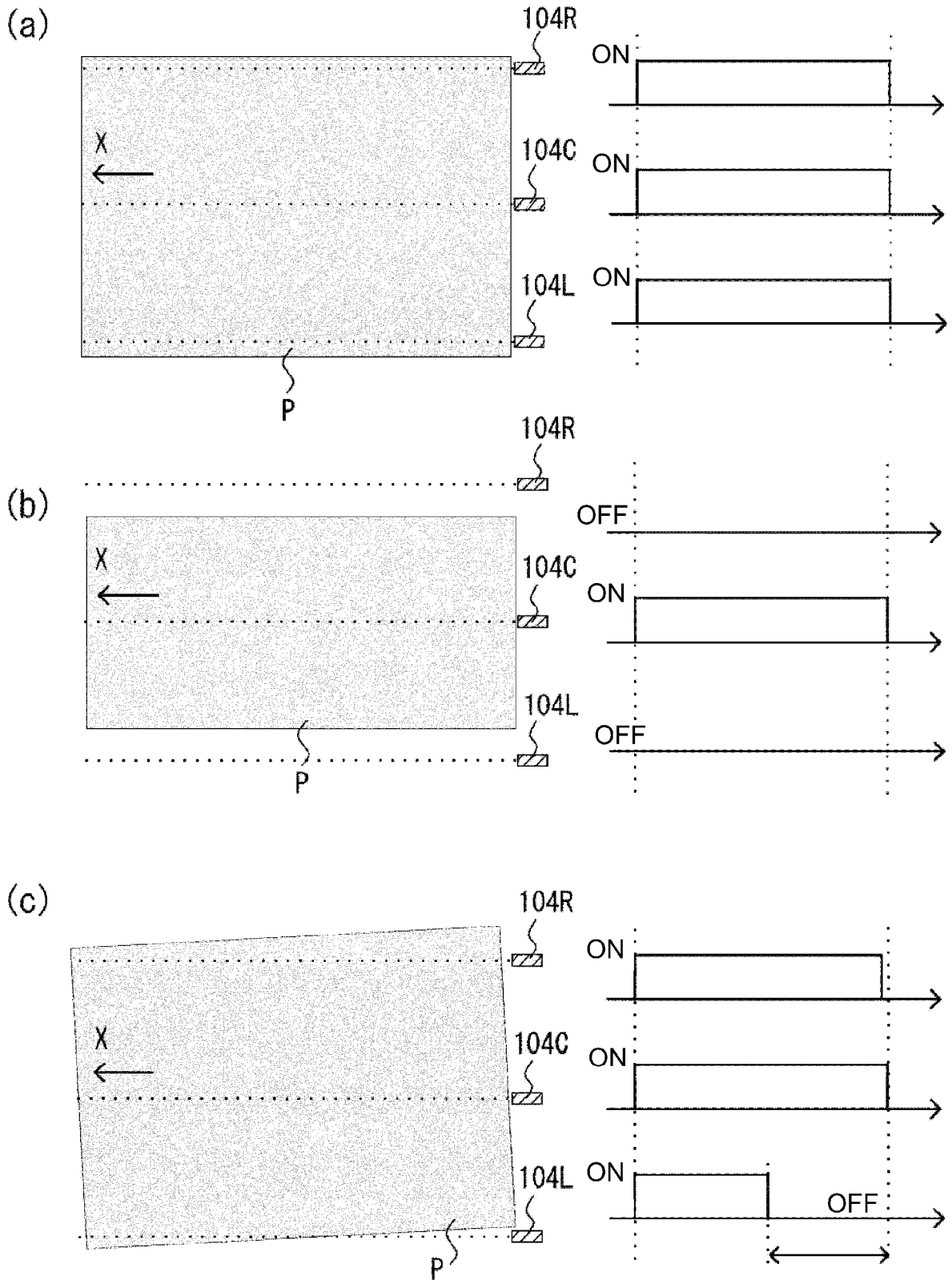

Parts (a), (b), and (c) of FIG. 7 are schematic views for illustrating detection of oblique movement of a recording material by the sensors.

Figure 8:
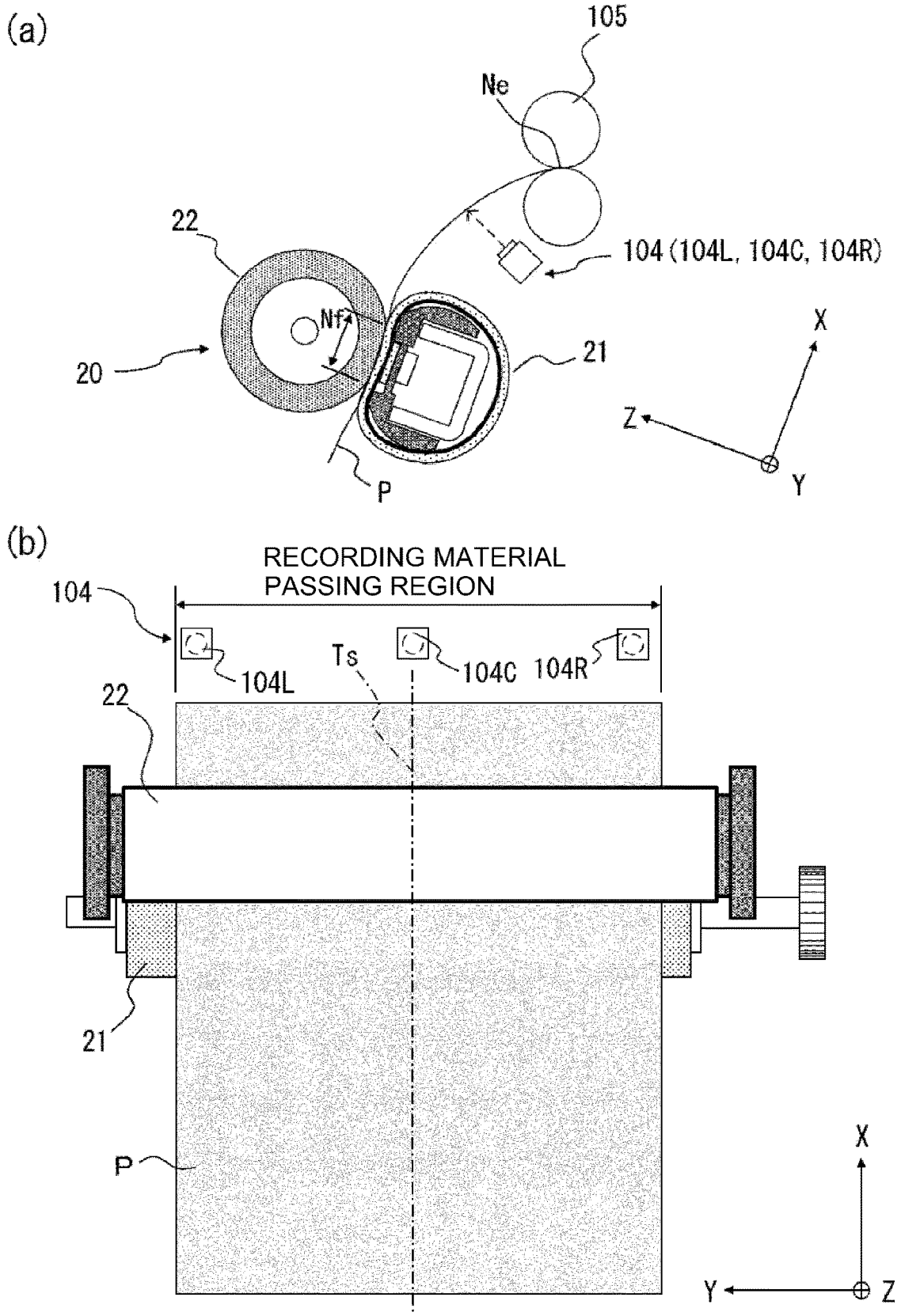

Parts (a) and (b) of FIG. 8 are schematic views for illustrating oblique movement detecting sensors of an image forming apparatus according to Embodiment 2.

DESCRIPTION OF EMBODIMENTS

Embodiments of the present invention will be described with reference to the drawings. Although these embodiments are preferred embodiments of the present invention, the present invention is not limited to the following embodiments, but constitutions thereof can be replaced with other various constitutions within a scope of a concept of the present invention.

Embodiment 1

Figure 1:
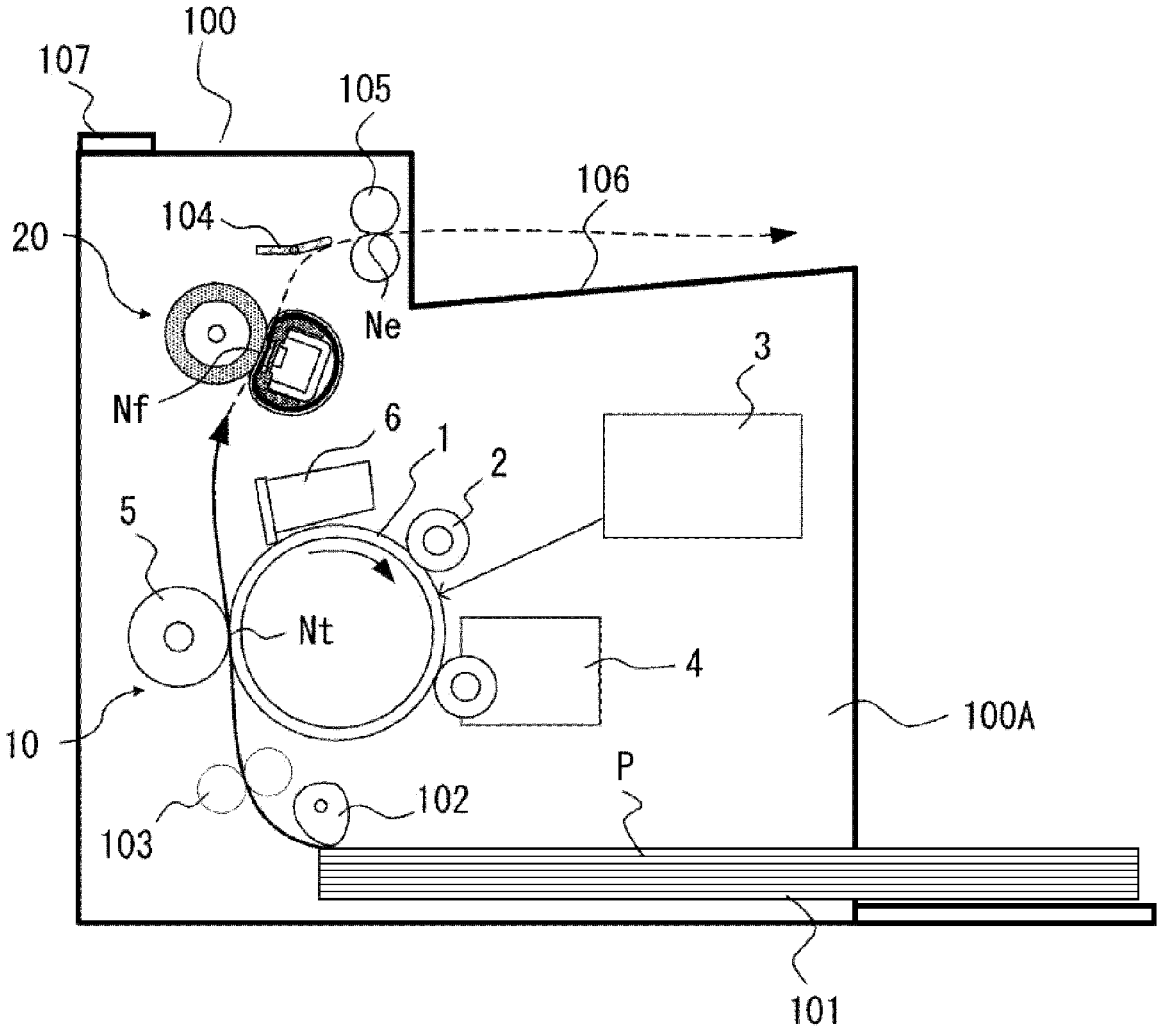
FIG. 1 is a sectional view showing a general structure of an image forming apparatus according to Embodiment 1.

With reference to FIG. 1, an image forming apparatus 100 according to this embodiment will be described. FIG. 1 is a sectional view showing a general structure of an example of the image forming apparatus 100. In this embodiment, the image forming apparatus 100 using an electrophotographic recording technique and is a monochromatic laser printer.

(General Structure of Image Forming Apparatus 100)

The image forming apparatus 100 includes an image forming portion 10 for forming an image on a recording material and a fixing portion for fixing the image, formed on the recording material, on the recording material (hereafter, this fixing portion is referred to as a fixing device 20).

The image forming portion 10 includes a photosensitive drum 1 as an image bearing member. In the image forming portion 10, a charging device 2, an exposure device 3 for irradiating a photosensitive drum surface with laser light, a developing device 4, a transfer member 5 and a cleaner 6 are provided around an outer peripheral surface of the photosensitive drum 1 and along a rotational direction (arrow direction) of the photosensitive drum 1 in the named order.

The photosensitive drum 1 is rotated in the arrow direction, and the photosensitive drum surface is electrically charged uniformly to a predetermined polarity and a predetermined potential. Then, an electrostatic latent image is formed by the laser light on the charged surface of the photosensitive drum 1. This electrostatic latent image is developed with toner by the developing device 4 and thus is visualized as a toner image.

The image forming apparatus 100 has an apparatus main assembly 100A. A cassette 101 is provided in the apparatus main assembly 100A. Recording materials P accommodated in the cassette 101 are fed one by one by rotation of a roller 102 as a supplying member. The recording material P is supplied by rotation of a roller pair 103 to a transfer nip Nt formed between the photosensitive drum 1 and the transfer member 5. At the transfer nip Nt, the toner image is transferred from the surface of the photosensitive drum 1 onto the recording material P by the transfer member 5 while nipping and feeding the recording material P. The surface of the photosensitive drum 1 after toner image transfer is cleaned by the cleaner 6.

The recording material P, on which an unfixed toner image is carried, is sent to a fixing device 20 where the toner image is fixed on the recording material P. The recording material P coming out of the fixing device 20 is fed to a roller pair 105 through an oblique movement sensor 104 The oblique movement sensor is an oblique movement detecting portion. The roller pair 105 is a discharging member, and the recording material P is discharged on a tray 106 by rotation of the roller pair 105.

In the image forming apparatus 100, the roller pair 105 has a discharging nip Ne on a side downstream of a fixing nip Nf of the fixing device 20 with respect to a recording material feeding direction. The oblique movement sensor 104 is provided between the fixing nip Nf and the discharging nip Ne. A distance between the transfer nip Nt and the fixing nip Nf is 40 mm, and a distance between the fixing nip Nf and the discharging nip Ne is 30 mm. A display portion 107 such as a display as a notifying portion is provided in the apparatus main assembly 100A. With respect to the recording material feeding direction, a length between the transfer nip Nt and the fixing nip Nf is shorter than a length of a maximum-size recording material (A4-size recording material in this embodiment) usable in the apparatus 100.

(Printer Control Device 200)

Figure 2:
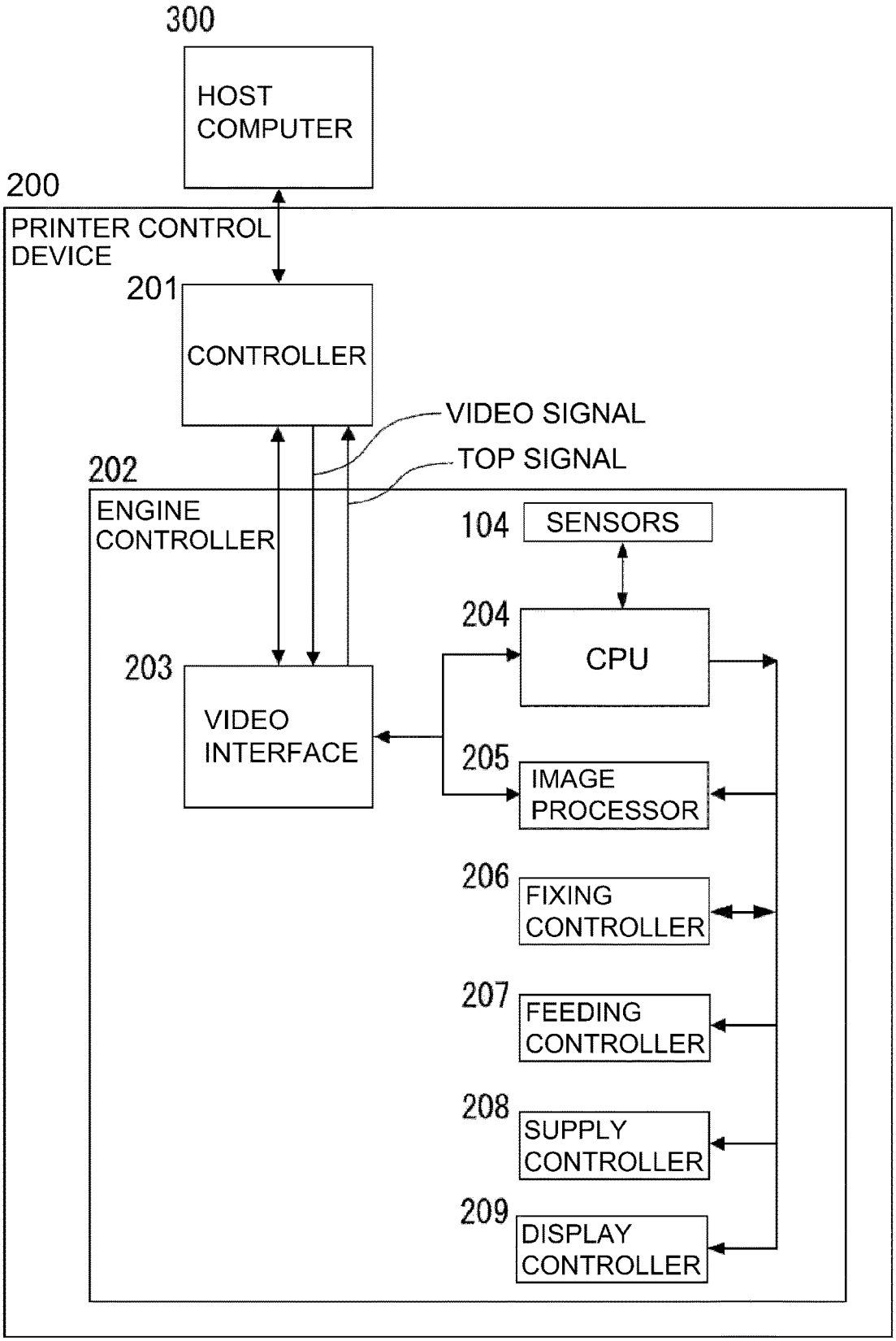
FIG. 2 is a block diagram showing a system constitution of a printer controlling device.

A printer control device 200 managing entire control of the apparatus 100 will be described with reference to FIG. 2. FIG. 2 is a block diagram showing a system constitution of the printer control device 200.

The printer control device 200 includes a controller portion 201 and an engine controller 202.

The controller portion 201 mutually communicates with a host computer 300 and the controller 202. The controller portion 201 receives image information and a print instruction from the host computer 300. The controller portion 201 analyzes the received image in formation and converts the image information into bit data. Then, the controller portion 201 sends a print reservation command, a print start command, and a video signal to the controller 202 via a video interface portion 203 for each of the recording materials P.

Further, the controller portion 201 sends the print reservation command in accordance with the print instruction from the host computer 300 and then sends the print start command to the controller 202 at timing when the image forming apparatus 100 is in a printable state.

When the controller 202 receives the print instruction, the controller 202 outputs a TOP signal providing output reference timing of the video signal to the controller portion 201 and executes a printing operation program. The controller portion 201, executing the printing operation program, controls a CPU 204 and an image processing portion 205 that are used as a control portion through the video interface portion 203. The CPU 204 starts an image forming operation (hereafter referred to as a printing operation) by controlling the image processing portion 205, a fixing controller 206, a feeding controller 207 and a supply (feeding) controller 208.

In the printing operation, the image processing portion 205 controls an operation of the image forming portion 10, and the fixing controller 206 controls an operation of the fixing device 20. The feeding controller 207 controls rotation of the roller pairs 103 and 105, and the supply controller 208 controls rotation of the roller 102.

Further, the CPU 204 controls the fixing controller 206, the supply controller 208 and a display controller 209 on the basis of an output signal of the oblique movement sensor 104.

(Fixing Device 20)

Figure 3:
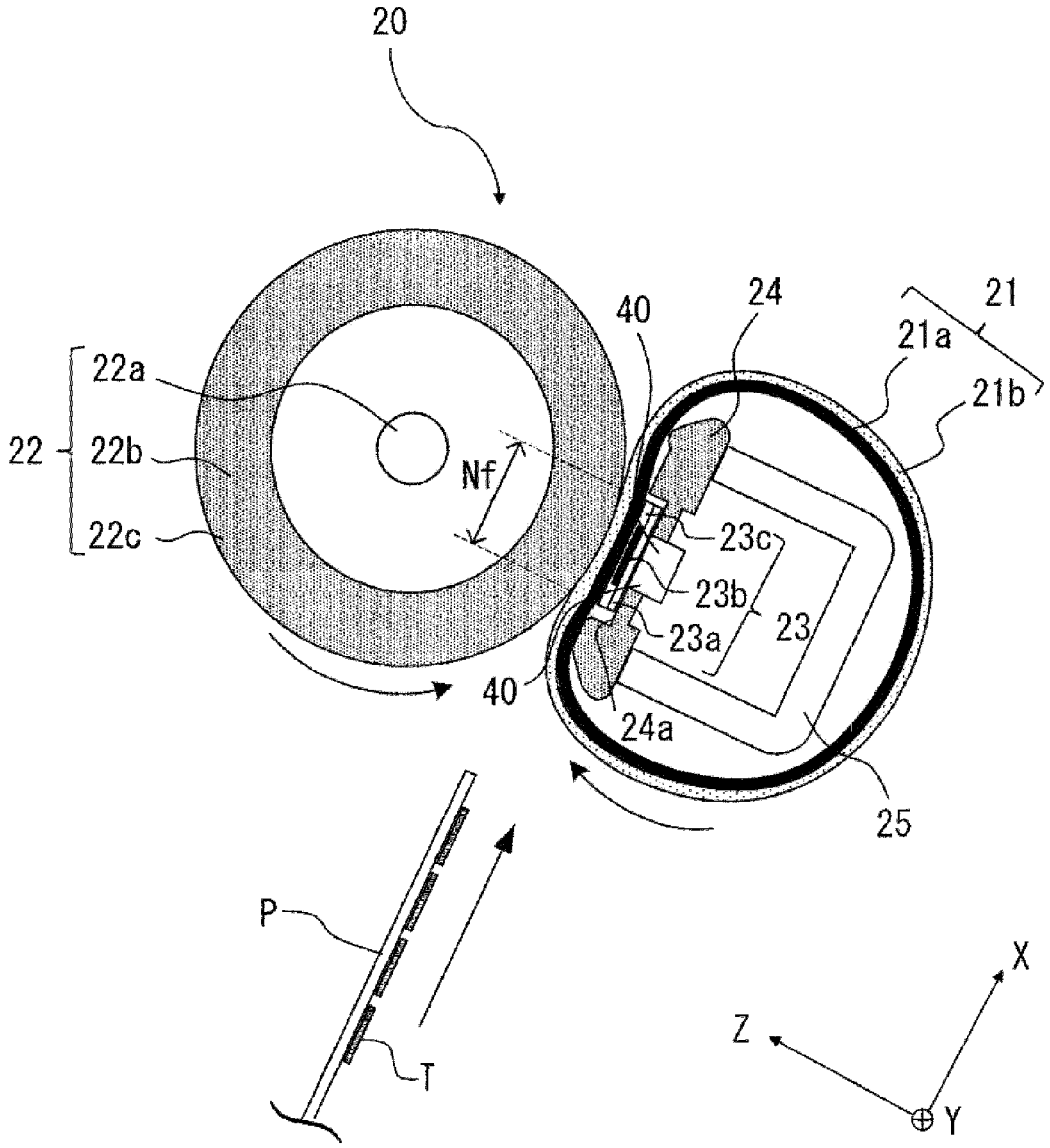
FIG. 3 is a sectional view showing a general structure of a fixing device.
Figure 4:
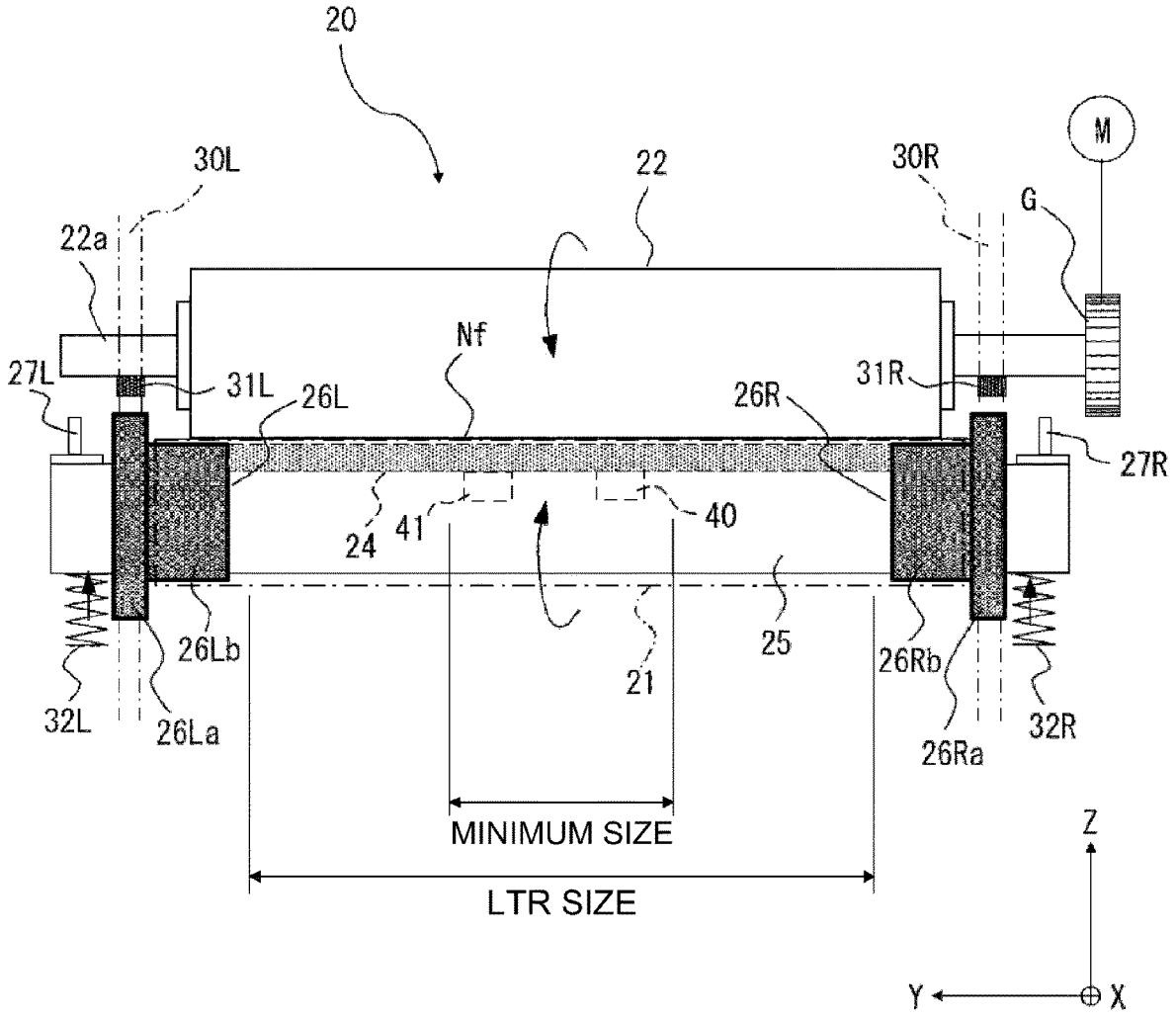
FIG. 4 is a schematic view of the fixing device as seen from an upstream side of a recording material feeding direction.

The fixing device 20 will be described with reference to FIGS. 3 and 4. The fixing device 20 in this embodiment is a fixing device of a film fixing type. FIG. 3 is a sectional view showing a general structure of the fixing device 20. FIG. 4 is a schematic view of the fixing device as seen from an upstream side of the recording material feeding direction.

In FIG. 4, in order to facilitate a positional relationship among a film 21 and flanges 26L and 26R, the film 21 is indicated by a chain line.

The fixing device 20 includes a cylindrical film 21, as a flexible, cylindrical rotatable member, and a pressing roller 22, as a rotatable pressing member, for forming the fixing nip Nf between itself and the film 21. The fixing device 20 further includes a ceramic heater 23, as a heating member for heating the recording material P on which a toner image T is fixed in the fixing nip Nf. The fixing device 20 further includes a holder 24, as a supporting member; a stay 25, as a rigid member; and the flanges 26L and 26R, as regulating (preventing) members.

(Film 21)

In a cylindrical state in which the film 21 is not deformed, the film 21 has an outer diameter of 18 mm. The film 21 has a multi-layer structure with respect to a film thickness direction. The layer structure of the film 21 includes a base layer 21*a* for maintaining strength of the film 21 and a parting layer 21*b* for reducing a degree of deposition of a contaminant on the outer peripheral surface of the film 21.

A material of the base layer 21*a* needs a heat-resistant property since the base layer 21*a* receives heat of the heater 23 and also needs strength since the base layer 21*a* slides with the heater 23, and therefore, metal such as stainless steel or nickel or a heat-resistant resin material such as polyimide may preferably be used as the material of the base layer 21*a*. In this embodiment, polyimide was used as the material of the base layer 21*a*, and a carbon (black)-based filler was added into the polyimide for improving thermal conductivity and strength. A thinner film more easily conducts the heat of the heater 23 to the surface of the film 21, but the strength of the film is lowered, and therefore, the thickness of the base layer 21*a* may preferably be about 15 μm-100 μm. In this embodiment, the thickness of the base layer 21*a* was 52 μm.

As a material of the parting layer 21*b*, a fluorine-containing resin material such as a tetrafluoroethylene-perfluoroalkyl vinyl ether copolymer (PFA), polytetrafluoroethylene (PTFE), a tetrafluoroethylene-hexafluoropropylene copolymer (FEP) may preferably be used. Of fluorine-containing resin materials, PFA has excellent parting properties and heat resistance, and in this embodiment, a PFA coating was formed in a thickness of 10 μm on an outer peripheral surface of the base layer 21*a*.

(Holder 24)

With respect to a longitudinal direction Y of the heater 23, which is a direction perpendicular to a recording material feeding direction X, the holder 24 supports the heater 23 by a groove 24*a* provided on a flat surface on the pressing roller 22 side. The film 21 is loosely fitted around the holder 24. On a flat surface of the holder 24, opposite from the detecting roller 22, the stay 25 made of metal (iron) for imparting strength to the holder 24 is provided.

As a material of the holder 24, a material having a low thermal capacity may preferably be used so that the heat of the heater 23 is not readily taken. In this embodiment, as the material of the holder 24, a liquid crystal polymer that is a heat-resistant resin material was used.

(Heater 23)

The heater 23 includes an elongated thin substrate 23*a* made of ceramic. On the substrate 23*a*, a heat generating resistor 23*b* is provided along a longitudinal direction of the substrate 23*a*, and thereon, a protective layer 23*c* for protecting the heat generating resistor 23*b* is provided. In this embodiment, a plate member, made of alumina and having dimensions of 6 mm with respect to the direction X and 1 mm with respect to a recording material thickness direction, was used as the substrate 23*a* of the heater 23. A 10 μm-thick heat generating resistor 23*b* made of silver-palladium was applied by screen printing onto the surface of the substrate 23*a*, and the heat generating resistor 23*b* was coated with a 50 μm-thick gloss layer as the protective layer 23*c*.

A dimension of the substrate 23*a* with respect to the direction Y is 260 mm. A corresponding dimension of the heat generating resistor 23*b* is 218 mm, which is longer than an LTR size by 1 mm on each of left and right sides, so that the heater 23 can sufficiently heat a recording material passing region of 216 mm of the LTR size which is a maximum size of the recording material P feedable in the apparatus 100 in this embodiment.

(Flanges 26L and 26R)

As shown in FIG. 4, with respect to the direction Y, at both end portions of the stay 25, the flanges 26L and 26R for regulating (preventing) a shift (movement) of the film 21 are engaged. These flanges 26L and 26R include collar portions 26La and 26Ra supported by left and right side plates 30L and 30R, respectively, of the fixing device 20 and include guiding portions 26Lb and 26Rb which are provided on inside surface sides of the collar portions 26La and 26Ra, respectively, and which guide rotation of the film 21 from an inner surface side of the film 21. The guiding portions 26Lb and 26Rb guide the rotation of the film 21 in regions outside a passing region of the LTR-size recording material P.

The rotation of the film 21 becomes unstable when the clearance between an inner peripheral length of the film 21 and an outer peripheral length of the guiding portions 26Lb and 26Rb is excessively large, but the film 21 is not readily rotated when the clearance is excessively small. Therefore, there is a need to properly set the clearance by appropriately taking variations in component parts into consideration. In this embodiment, an outer diameter of the guiding portions 26Lb and 26Rb is designed so as to provide a clearance of 1.0 mm.

(Pressing Roller 22)

An outer diameter of the pressing roller 22 is 18 mm. This pressing roller 22 is prepared by providing a 3.5 mm-thick elastic layer (foam rubber) 22*b* formed with a foam silicone rubber on an outer peripheral surface of a core metal made of iron and having an outer diameter of 11 mm. On another peripheral surface of the elastic layer 22*b*, as a parting layer, a parting layer 22*c* made of PFA is provided. The parting layer 22*c* may also be a layer formed by coating the outer peripheral surface of the elastic layer with a tube or with paint, but in this embodiment, a PFA tube excellent in durability was used.

As regards a surface hardness of the pressing roller 22, a large dimension of the fixing nip Nf with respect to the direction X can be enhanced at a lower (lighter) pressure with a lower surface hardness, but when the surface hardness is excessively low, durability of the pressing roller 22 lowers, and therefore, in this embodiment the surface hardness was 40° as measured in terms of Asker-C hardness (load: 4.9 N).

As shown in FIG. 4, with respect to the direction Y, both end portions of the core metal 22*a* of the pressing roller 22 are rotatably supported by the side plates 30L and 30R through bearings 31L and 31R. Both end portions of the stay 25 are pressed (urged) in a direction (recording material thickness direction Z) perpendicular to a generatrix direction of the film 21 by pressing (urging) springs 32L and 32R. By pressing forces (pressures) of the pressing springs 32L and 32R, the elastic layer 22*b* of the pressing roller 22 is elastically deformed, so that the fixing nip Nf having a predetermined dimension with respect to the direction X is formed between the pressing roller 22 surface and the film 21 surface.

(Heat-Fixing (Process) Operation)

When a motor M (FIG. 4) is rotationally driven by the fixing controller 206, rotation of the motor M is transmitted to a gear G provided at one end portion of the pressing roller 22, whereby the pressing roller 22 is rotated in an arrow direction shown in FIG. 3. In this embodiment, the pressing roller 22 is rotated at a surface movement speed of 120 mm/sec. The film 21 is rotated in an arrow direction shown in FIG. 3 by the rotation of the pressing roller 22 while an inner surface thereof slides with the protective layer 23*c* of the heater 23.

When electric power is supplied from a power source (not shown) to the heat generating resistor 23*b* of the heater 23 under control of the fixing controller 206, the heat generating resistor 23*b* generates heat, so that the heater 23 abruptly increases in temperature. The fixing controller 206 controls an amount of electric power supply (energization) to the heater 23 so that the temperature of the heater 23 is maintained at a predetermined fixing temperature (target temperature), on the basis of a detection temperature outputted from a thermistor 40 (FIG. 3) as a temperature detecting portion for detecting the temperature of the heater 23.

In FIG. 4, a temperature fuse 41 supported together with the thermistor 40 by the holder 24 is provided. When the temperature of the heater 23 becomes an abnormally high temperature, the temperature fuse 41 blows and thus electric power supply from the power source to the heater 23 is cut off. With respect to the Y direction, the temperature fuse 41 and the thermistor 40 are provided in the sheet passing region of the minimum-size recording material usable in the apparatus 100. In this embodiment, the minimum-size recording material passing region is 76 mm.

The recording material P carrying an unfixed toner image T is heated in the fixing nip Nf while being nipped and fed through the fixing nip Nf, whereby the toner image is fixed on the recording material P.

(Shifting Force Generating Mechanism of Film 21)

A mechanism that generates film shift in the case when the recording material P obliquely moved is fed to the fixing device 20 will be described with reference to FIG. 5. In FIG. 5, a size of the recording material P shown in FIG. 5 is an A4 size. Part (a) of FIG. 5 shows a state in which the recording material P is fed to the fixing device 20 in parallel to the direction X.

The film 21 is rotated by the pressing roller 22 through the recording material P. The fixing device 20 in this embodiment feeds the recording material P at a speed higher than a recording material feeding speed of the image forming portion 10 by about 1% due to thermal expansion. For that reason, in the case when the recording material P is nipped and fed through the fixing nip Nf and the transfer nip Nt, the recording material P is fed in a state in which a back tension of about several hundred grams is applied to the recording material P by the transfer nip Nt. However, in part (a) of FIG. 5, the recording material P is not obliquely moved, and therefore, forces F1, F2 and F3 exerted on the recording material P in the fixing nip Nf for rotating the film 21 are equal to each other. As a result, movement where a left end side of the film 21 is rotated faster than a right end side of the film 21 (as described later) does not occur.

Part (b) of FIG. 5 shows a state in which the recording material P is obliquely moved and fed from the image forming portion to the fixing device 20. A trailing end of the recording material P with respect to the recording material feeding direction X is obliquely moved so that a right side of the trailing end is positioned downstream of a left side of the trailing end with respect to the direction X, and therefore, by an influence of the back tension exerted on the recording material P on the right side by the transfer nip Nt, the force F3 acting on the film 21 on the right side of the film 21 becomes small.

The reason why the feeding force F3 becomes small will be specifically described using parts (c) and (d) of FIG. 5. Part (c) of FIG. 5 is a schematic view showing the recording material P which is obliquely moved, and part (d) of FIG. 5 is a schematic view showing the recording material P which is not obliquely moved.

In the case when the recording material P is not obliquely moved, as shown in part (d) of FIG. 5, back tensions Fb1 acting on a bilaterally symmetrical region D with respect to a center line Pc of the recording material P are equal to each other on left and right sides with respect to the direction Y, so that forces acting on the film 21 are also equal to each other on left and right sides.

On the other hand, in the case when the recording material P is obliquely moved, as shown in part (c) of FIG. 5, a back tension Fb2 acts on a bilaterally asymmetrical region E, and therefore, the back tensions are higher on the right side than on the left side, with respect to the direction Y, by an amount corresponding to the back tension Fb2. As a result, the feeding force F3 acting on the film 21 on the right end side of the film 21 is decreased by pulling of the film 21 by the recording material P.

Further, on the left end side, a non-sheet-passing region where the recording material P does not pass increases with advance of the feeding of the recording material P, and therefore, overheating is caused in the non-sheet-passing region. For that reason, a region of the pressing roller 22 contacting the film 21 in the non-sheet-passing region is thermally expanded more than that in a normal state, so that the feeding force F1 acting on the film 21 on the left side of the film 21 increases.

The force F1 increases and the force F3 decreases, and therefore, the film 21 is rotated faster on the left end side than on the right end side in the fixing nip Nf, whereby rotation moment shown by an arrow RM of part (b) of FIG. 5 generates on the film 21. For that reason, corresponding to the clearance between the inner peripheral length of the film 21 and each of the outer peripheral lengths of the guiding portions 26Lb and 26Rb of the flanges 26L and 26R, the left end side of the film 21 is inclined toward an upstream side with respect to the recording material feeding direction, and the right end side of the film 21 is inclined toward a downstream side with respect to the recording material feeding direction. By rotation of the film 21 in an inclined state, the film 21 is gradually moved in a left direction shown by an arrow L of part (b) of FIG. 5 with respect to the direction Y.

When the film 21 is moved in the left direction L and abuts against the collar portion 26La of the flange 26L, the film 21 receives a reaction force from the flange 26L. When this reaction force is large, there is a liability that the film 21 is deformed so as to be flared out on the left side of the film 21 and a film end portion is broken.

(Correlation Between Shifting Force of Film 21 and Throughput of Recording Material P)

A magnitude of the shifting force of the film 21 is largely caused by the recording material P, and therefore, it is not preferable that obliquely moved recording materials with the same throughput as that of recording material which are not obliquely moved are continuously fed to the transfer nip Nt of the image forming portion 10.

When a feeding (supply) interval of the recording materials P to the transfer nip Nt is increased, the position of the film 21 is somewhat returned toward an original position by the reaction force from the flange 26L (or 26R), so that the shifting force is relaxed. In this embodiment, the throughput is lowered by increasing the feeding interval of the recording materials P to the transfer nip Nt for recording material P having a size smaller than the A4 size (small-size recording materials) in order to relax (alleviate) the overheating in the non-sheet-passing region of the film 2. For that reason, even when the oblique movement occurred, a possibility of breakage of the film end portion due to the shift of the film is smaller in the case of the small-size recording materials P.

In this embodiment, LTR(-size) sheets and A4(-size) sheets are assumed as the recording material P which is an object to be detected for to the oblique movement. LTR sheets and A4 sheets are recording materials having a highest are frequency, and therefore, there is a need to carry out printing with a maximum throughput. The size of the LTR sheet is 279 mm in dimension with respect to the direction X and 216 mm in dimension with respect to the longitudinal direction perpendicular to the direction X. The size of the A4 sheet is 297 mm in dimension with respect to the direction X and 210 mm in dimension with respect to the direction Y perpendicular to the direction X. When the LTR sheet and the A4 sheet are compared with each other, the dimension of the LTR sheet with respect to the direction Y is substantially equal to a dimension of a recording material feeding path of the apparatus 100 in this embodiment.

For that reason, an error is not readily caused to occur when a user accommodates the LTR sheets in the cassette 101 and sets the LTR sheets by bringing regulating plates (not shown) provided in the cassette 101 for regulating left ends (edges) and right ends (edges) of the LTR sheets (recording materials P) into contact with the left ends and the right ends of the LTR sheets, so that oblique movement of the LTR sheets is not readily caused to occur. If the LTR sheets are obliquely moved, with respect to the direction Y, the left and right ends of the LTR sheet contact side plates (not shown) of the recording material feeding path and are liable to be damaged, and therefore, it can be expected that the user notices the oblique movement and rectifies the setting of the LTR sheets.

On the other hand, the A4 sheets are set, in some instances, in a state in which the regulating plates of the cassette 101 set where the they would be in contact with the left and right ends of the LTR sheets. In such a case, the regulating plates do not function, and therefore, oblique movement of the A4 sheets is liable to occur. The dimension of the A4 sheets with respect to the direction Y is smaller than the dimension of the LTR sheets by about 6 mm, and therefore, even when the A4 sheets are obliquely moved and fed, left and right ends of the A4 sheets do not readily contact the side plates of the recording material feeding path.

For that reason, the case when the A4 sheets are continuously fed to the transfer nip Nt while the user does not notice the oblique movement is assumed. Therefore, it is desirable that the oblique movement of the A4 sheets of the recording materials P fed with the maximum throughput is made detectable.

(Oblique Movement Sensor 104)

An oblique movement sensor 104 for detecting the oblique movement of the recording material nipped and fed by the fixing nip Nf and the discharging nip Ne will be described with reference to FIG. 6. Part (a) of FIG. 6 is a sectional view showing a general structure of the oblique movement sensor 104, and part (b) of FIG. 6 is a schematic view showing a positional relationship among first sensors 104L and 104R, a second sensor 104C, and the recording material P.

The oblique movement sensor 104 is provided, as shown in part (a) of FIG. 6, on a non-printing surface side (the pressing roller 22 side of the fixing device 20) opposite from a printing surface of the recording material P between the fixing nip Nf and the discharging nip Ne. This oblique movement sensor 104 includes, as shown in part (b) of FIG. 6, the first sensors 104L and 104R provided inside both ends of the recording material passing region and the second sensor 104C provided at a central portion between the first sensors 104L and 104R with respect to the direction Y. Each of the respective sensors 104L, 104R and 104C detects the presence or absence of the recording material P. Here, the recording material passing region refers to a passing region of the A4-size recording materials.

These sensors 104L, 104R and 104C are provided at positions spaced from a center of the fixing nip Nf with respect to the recording material feeding direction toward the roller pair 105 side by 20 mm and spaced from a center of the discharging nip Ne with respect to the recording material feeding direction toward the fixing device 20 side by 10 mm. The sensors 104L and 104R are disposed at positions of L1=100.5 mm from a recording material feeding reference line Ts toward left and right ends, respectively, of the recording material P. That is, the sensors 104L and 104R are disposed at positions where the oblique movement of the A4-size recording materials P can be detected.

As a result, the respective sensors 104L, 104R and 104C are capable of detecting the oblique movement of the recording material P at timing when a leading end side of the recording material P with respect to the recording material feeding direction X is nipped and fed through the discharging nip Ne and a trailing end side of the recording material P with respect to the recording material feeding direction X is nipped and fed through the fixing nip Nf.

Each of the sensors 104L, 104R and 104C includes, as shown in part (a) of FIG. 6, a photo-coupler 104*a* and a sensor lever 104*b*.

In each of the sensors 104L, 104R and 104C, the lever 104*b* is swingable about a supporting shaft 104*bs*. This lever 104*b* projects to a recording material feeding path Tp at one end portion 104*b*-1 thereof, as indicated by a broken line in part (a) of FIG. 6, in a non-contact state with the recording material P. In this state, the other end portion 104*b*-2 of the lever 104*b* blocks an optical path of the photo-coupler 104*a*. As a result, the photo-coupler 104*a* is maintained in an off state. That is, the respective sensors 104L, 104R and 104C are maintained in an off state.

Further, when the recording material P fed through the recording material feeding path Tp contacts the one end portion 104*b*-1 of the lever 104*b*, the lever 104*b* is swung about the supporting shaft 104*bs* by being pushed by the recording material P. As a result, as indicated by a solid line of part (a) of FIG. 6, the other end portion 104*b*-2 of the lever 104*b* escapes from the optical path of the photo-coupler 104*a*, so that the photo-coupler 104*a* is in an on state. That is, the respective sensors 104L, 104R and 104C are in an on state. The on state of the sensors 104L, 104R and 104C is maintained until the recording material P completely passes through the positions of the levers 104*b*.

After the passing of the recording material P through the positions of the levers 104*b* is ended, the levers 104*b* are swung and returned to original attitudes, whereby the state of the respective sensors 104L, 104R and 104C is returned to the off state.

(Oblique Movement Detection of Recording Material P)

Oblique movement detection of the recording material P by the oblique movement sensor 104 will be described with reference to FIG. 7. Parts (a) to (c) of FIG. 7 are schematic views each showing a relationship between the oblique movement sensor 104 and the recording material P detected by the oblique movement sensor 104. Part (a) of FIG. 7 shows the case when the A4-size recording material P which is not obliquely moved is detected by the oblique movement sensor 104. Part (b) of FIG. 7 shows the case when the recording material P which has a size smaller than the A4 size and which is not obliquely moved is detected by the oblique movement sensor 104. Part (c) of FIG. 7 shows the case when the A4-size recording material P which is obliquely moved is detected by the oblique movement sensor 104.

In the oblique movement sensor 104 of FIG. 2, the photo-couplers 104*a* of the sensors 104L, 104R and 104C of the oblique movement sensor 104 output on and off signals to the CPU 204.

After the printing operation is started, in the case when the on signals are not inputted from the respective sensors 104L, 104R and 104C in a predetermined time, the CPU 204 determines that the recording material P has jammed in the fixing nip Nf or in the discharging nip Ne. Then, the CPU 204 stops the printing operation by controlling the image processing portion 205, the fixing controller 206, the feeding controller 207, and the supply controller 208.

In the case when the on signals are inputted from the respective sensors 104L, 104R and 104C, as shown in part (a) of FIG. 7, the CPU 204 determines that the recording material is the A4-size recording material P that is not obliquely moved, so that the printing operation is performed with an outputtable maximum throughput.

In the case when the off signals are inputted from the sensors 104L and 104R and the on signal is inputted from the sensor 104*c*, as shown in part (b) of FIG. 7, the CPU 204 determines that the recording material is the recording material P that has the size smaller than the A4 size and that is not obliquely moved. Then, in order to suppress the overheating of the film 21 in the non-sheet-passing region, the CPU 204 causes the supply controller 208 to control rotation of the roller 102, so that the feeding interval of the recording material P is increased and then the printing operation is performed with a throughput slower (lower) than the maximum throughput.

Part (c) of FIG. 7 shows the case when the recording material P is obliquely moved and fed due to erroneous setting of the recording materials P in the cassette 101. Substantially simultaneously with the turning-on of the sensor 104C at the leading end of the recording material P with respect to the direction X, the sensors 104R and 104L are also turned on.

On the basis of input of the on signals from the sensors 104R, 104C and 104L, the CPU 204 determines that the recording material is the A4-size recording material P that is obliquely moved, so that the printing operation is performed with the maximum throughput. However, the recording material P is obliquely moved, and therefore, although a time of turned-off of the sensor 104R is close to a time of turned-off of the sensor 104C, the sensor 104L is out of the left end of the recording material P and is turned off during feeding of the recording material P. The CPU 204 compares a time of turning-off of the sensor 104L with the time of turning-off of the sensor 104C and determines that the oblique movement occurs when a time difference therebetween (hereafter referred to as a difference) $\Delta t$ exceeds a threshold time S.

In this embodiment, the threshold time S is 600 msec. The recording material feeding speed is 120 mm/sec, so that the CPU 204 determines that the oblique movement occurs in the case when the sensor 104L is out of the left end of the recording material P and is turned off at a time earlier than a time when a position of the left end (edge) of the recording material P is 72 mm from the trailing left end of the recording material P with respect to the direction X. That is, in the case when the oblique movement is positioned by the threshold time S, when the recording material P is nipped and fed through the fixing nip Nf and the discharging nip Ne, either one of the sensors 104L and 104R detects absence of the recording material P.

The threshold time S may only be required to be appropriately set depending on an allowable oblique movement amount, but may desirably be set at a value larger than a value obtained by dividing a distance (20 mm) from the fixing nip Nf to the oblique movement sensor 104 by the speed (120 mm/sec) at which the recording material P is nipped and fed. It is preferable that the threshold time S is set at a value larger than 167 msec. In the case when determination of the oblique movement detection is made based on the threshold time S set as described above, the determination can be made whether or not the sensor 104L (or 104R) is turned off when the recording material P is nipped and fed through the fixing nip Nf and the discharging nip Ne.

The rigidity of the recording material P on the recording material leading end side or the recording material trailing end side with, respect to the direction X, may be insufficient depending on a kind and a basis weight of the recording material P, and therefore, the recording material P is liable to flap (flutter). As a result, when sensor-on timing or sensor-off timing of the sensor 104R or 104L is intended to be determined based on the recording material leading end side or on the recording material trailing end side, it is difficult to detect the oblique movement of the recording material P with accuracy.

In this embodiment, as described above, the turning-on and the turning-off of the sensors 104R and 104L can be determined at timing when the recording material leading end side is nipped and fed through the discharging nip Ne and the recording material trailing end side is nipped and fed through the fixing nip Nf. The recording material P is nipped and fed through the fixing nip Nf and the discharging nip Ne, and therefore, the rigidity of the recording material P against the sensors 104R and 104L increases, whereby it is possible to reduce a variation in detection result due to the flapping of the recording material P on the leading end side or on the trailing end side. That is, oblique movement detection accuracy of the recording material P can be improved.

Further, in this embodiment, the threshold time S is set so that discrimination of the oblique movement is made in the case when the sensor 104L is out of the left end of the recording material P or in the case when the sensor 104R is out of the right end of the recording material P. For that reason, even when recording material trailing end detection timings between the sensors 104L and 104C or between the sensors 104R and 104C somewhat vary, an influence thereof is small, so that an S/N ratio can be made large. Therefore, the oblique movement detection accuracy of the recording material P can be improved.

In this embodiment, the recording material center line Pc (part (d) of FIG. 5) and the recording material feeding reference line Ts (part (c) of FIG. 6) coincide with each other. When oblique movement of about 2% or more occurs for A4-size recording material P, the difference Δt exceeds the threshold time S, so that a determination that the recording material P is obliquely moved is made.

Further, in this embodiment, the sensors 104L, 104R and 104C are provided on the side downstream of the fixing nip Nf with respect to the recording material feeding direction, and therefore, the oblique movement of the recording material P causing the shifting force to act on the film 21 can be detected with accuracy.

(Relaxing Operation of Film 21 Shifting Force)

In the case when the oblique movement of the recording material P is detected by the sensors 104L, 104R and 104C, a relaxing operation of the shifting force for shifting the film 21 is performed under control of the CPU 204. In the apparatus of this embodiment, as the relaxing operation, at least one of the following relaxing operations (1) to (4) is set.

Relaxing Operation (1)

When the oblique movement of the recording material P is detected, the CPU 204 controls the supply controller 208, so that a rotation start timing of the roller 102 is delayed from the start timing during a normal operation and thus the feeding interval of the recording material P is increased. As a result, a time in which the recording material P is nipped fed through the fixing nip Nf can be ensured, and therefore, the shifting force of the film 21 can be relaxed.

The feeding interval, in terms of time, for a maximum throughput when the A4-size recording materials P are continuously fed to the transfer nip Nt is 495 msec in this embodiment. When the feeding interval is converted into a distance, the feeding interval is 59.4 mm. In this embodiment, when the above-described relaxing operation is performed after the oblique movement of the recording material P is detected, the time of the feeding interval is set at 7 sec, so that the throughput is reduced (throughput down). This reduced throughput is carried out in a manner such that when the oblique movement of a preceding single recording material is detected, the feeding interval of a single recording material subsequent to the preceding single recording material is increased. This is because all subsequent recording materials P causes the throughput to be reduced due to unexpected occurrence of the oblique movement.

In this embodiment, the shifting force of the film 21, which is 11.8 N as a maximum (value), can be relaxed to about 9.8 N by the above-described reduced throughput, so that the reaction force received from the flange 26L or 26R can be reduced.

In this embodiment, the printing operation has already been started for a recording material P fed immediately after the preceding recording material for which oblique movement has been detected, and therefore, an operation of increasing the time of the feeding interval of the recording material P immediately subsequent to the preceding recording material P is not in time for the printing operation. For that reason, the time of the feeding interval is delayed for a recording material P subsequent to the subsequent recording material P (subsequent to the preceding recording material P).

Relaxing Operation (2)

When the oblique movement is detected, the CPU 204 controls the image processing portion 205, the fixing controller 206, the feeding controller 207 and the supply controller 208, so that the printing operation is stopped. Then, the CPU 204 sends an oblique movement status to the host computer 300 via the video interface portion 203 and the controller portion 201. The host computer 300 receives the oblique movement status and provides a notification to a user to check a position of the recording materials P in the cassette 101, and thus prompts the user to rectify (correct) the position of the recording materials P. By rectifying the position of the recording materials P, the shifting force for shifting the film 21 can be relaxed.

Relaxing Operation (3)

When the oblique movement is detected, the CPU 204 controls the image processing portion 205, the fixing controller 206, the feeding controller 207, and the supply controller 208, so that the printing operation is stopped. Then, the CPU 204 controls the display controller 209 so as to cause the display portion 107 to display an oblique movement status and to display a notification indicating that the position of the recording materials P in the cassette 101 should be checked, and thus provides notification to the user and prompts the user to rectify the position of the recording materials P. By rectifying the position of the recording materials P, the shifting force for shifting the film 21 can be relaxed.

Relaxing Operation (4)

When the oblique movement is detected, the CPU 204 controls the image processing portion 205, the fixing controller 206, the feeding controller 207, and the supply controller 208, so that the printing operation is stopped. Then, the CPU 204 controls the fixing controller 206, so that solenoids (pressure releasing portions 27L and 27R) are turned on or an eccentric cam is rotated by a motor. As a result, the stay 25 of the fixing device 20 moves together with the film 21 toward a side opposite from the pressing roller 22 against pressing forces (pressures) of the pressing springs 32L and 32R, so that a press-contact state between the film 21 and the pressing roller 22 is released. As a result, the shifting force for shifting the film 21 is released and thus can be relaxed.

Embodiment 2

Another embodiment of the image forming apparatus 100 will be described. An image forming apparatus 100 of this embodiment has the same constitution as the image forming apparatus 100 of Embodiment 1 except that an oblique movement sensor is different from the oblique movement sensor in Embodiment 1. In this embodiment, as an oblique movement sensor 104, a non-contact threshold detecting element with the recording material P is used. Part (a) of FIG. 8 is a sectional view showing a general structure of the oblique movement sensor 104, and part (b) of FIG. 8 is a schematic view showing a positional relationship among first sensors 104L and 104R, a second sensor 104C, and the recording material P.

Each of oblique movement sensors 104L, 104C, and 104R use the same thermopile as the temperature detecting element. As shown in part (a) of FIG. 8, the thermopile is provided on a printing surface side (the film 21 side of the fixing device 20) of the recording material P between the fixing nip Nf and the discharging nip Ne. The positions of the respective sensors 104L, 104C, and 104R, with respect to the direction X and the direction Y, are the same as the positions of the respective sensors 104L, 104C, and 104R Embodiment 1.

In general, a temperature of the recording material P nipped and fed through the fixing nip Nf reaches a temperature of 100° C. or more. In this embodiment, on the basis of temperature data acquired from the thermopiles, determination that the recording material P is present occurs when the temperature is 70° C. or more and determination that the recording material P is absent occurs when the temperature is less than 70° C. An oblique movement determination condition or a relaxing operation of the shifting force for shifting the film 21 is the same as that in Embodiment 1. Therefore, the image forming apparatus 100 of this embodiment is also capable of achieving the same effect as the effect of the image forming apparatus 100 of Embodiment 1.

In this embodiment, temperature information of the recording material P is acquired by the sensors 104L, 104C, and 104R and can be fed back to a fixing temperature controlled on the basis of a detection temperature of the thermistor 40. Specifically, when the temperature of the recording material P is high, excessive supply of heat to the recording material P is prevented by setting the fixing temperature at a low value. Thus, the temperature information of the recording material P is fed back to the fixing temperature, whereby unnecessary electric power consumption can be reduced while obtaining a uniform fixing property.

Further, a difference in degree of overheating of the film 21 in non-sheet-passing regions between on the left side and on the right side is predicted on a temperature difference between the sensors 104L and 104R, whereby the time of the feeding interval of the recording material P after the detection of the occurrence of the oblique movement is corrected. Specifically, when the temperature difference between the sensors 104L and 104R is 10° C. or more, 1 sec is added to the time of the feeding interval, so that the corrected time of the feeding interval is 8 sec. Thus, by correcting the time of the feeding interval of the recording material P based on the temperature difference between the sensors 104L and 104R, a degree of an increase in shifting force for shifting the film 21 in the case when a degree of the overheating of the film 21 in the non-sheet-passing regions is large can be reduced.

ANOTHER EMBODIMENT

The fixing device is not limited to the fixing device of the film heating type. The fixing device may also be a fixing device of a heating roller type in which a cylindrical heating roller incorporating a halogen heater is provided on the printing surface side of the recording material and a pressing film unit for forming a nip by bringing a cylindrical film incorporating a pressing member into press-contact with the heating roller is provided on the non-printing surface side.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus for forming an image on a recording material, the image forming apparatus comprising:

an image forming portion configured to form the image on the recording material;

a fixing portion including a flexible, cylindrical rotatable member and a roller in press contact with said rotatable member, said rotatable member and said roller being configured to form a fixing nip in which the recording material, on which the image is formed, is nipped and fed, the fixing portion being configured to fix the image on the recording material;

an oblique movement detecting portion configured to detect oblique movement of the recording material; and a control portion, wherein, when said oblique movement detecting portion does not detect the oblique movement of a first recording material, said control portion is configured to control an interval between the first recording material and a second recording material to be a first feeding interval, the second recording material being a recording material to be fed immediately after the first recording material, and wherein, when said oblique movement detecting portion detects the oblique movement of the first recording material, (i) said control portion is configured to control the interval to be a second feeding interval, the second feeding interval being longer than the first feeding interval, and (ii) the fixing portion fixes the image on the first recording material while the first recording material remains oblique.

2. The image forming apparatus according to claim 1, further comprising an accommodating portion configured to accommodate the recording material to be supplied to said image forming portion, wherein, when said oblique movement detecting portion detects the oblique movement of the recording material, said control portion provides notification to check a position of the recording material accommodated in said accommodating portion.

3. The image forming apparatus according to claim 1, further comprising a roller pair provided immediately behind said fixing portion and configured to nip the recording material, wherein said oblique movement detecting portion is provided between said fixing portion and said roller pair with respect to a recording material feeding direction.

4. The image forming apparatus according to claim 3, wherein said oblique movement detecting portion includes a central sensor provided at a central portion of a feeding path with respect to a direction perpendicular to the recording material feeding direction and an end sensor provided at an end portion of the feeding path with respect to the direction perpendicular to the recording material feeding direction, each of said central sensor and said end sensor being configured to detect the recording material.

5. The image forming apparatus according to claim 4, wherein each of said central sensor and said end sensor is a photo coupler.

6. The image forming apparatus according to claim 4, wherein each of said central sensor and said end sensor is a temperature sensor.

7. The image forming apparatus according to claim 1, wherein said image forming portion includes a transfer nip in which the image is transferred onto the recording material, and wherein a length between the fixing nip and the transfer nip is shorter than a length of a maximum size recording material usable in said image forming apparatus with respect to the recording material feeding direction.

8. The image forming apparatus according to claim 1, wherein said fixing portion includes a heater configured to form the fixing nip in cooperation with said roller between said rotatable member and said roller.

9. The image forming apparatus according to claim 1, wherein, when said oblique movement detecting portion detects the oblique movement of the first recording material, said control portion is configured to discharge the first recording material without correcting the oblique movement of the first recording material.

10. An image forming apparatus for forming an image on a recording material, the image forming apparatus comprising:

an image forming portion configured to form the image on the recording material;

an accommodating portion configured to accommodate the recording material to be supplied to said image forming portion;

a feeding portion configured to feed the recording material to said image forming portion from said accommodating portion at a feeding timing;

a fixing portion including a flexible, cylindrical rotatable member and a roller in press contact with said rotatable member, said rotatable member and said roller being configured to form a fixing nip in which the recording material, on which the image is formed, is nipped and fed, the fixing portion being configured to fix the image on the recording material;

an oblique movement detecting portion configured to detect oblique movement of the recording material; and a control portion configured to control the feeding timing of said feeding portion, wherein, when said oblique movement detecting portion detects the oblique movement of the recording material, (i) said control portion controls said feeding portion to increase a feeding interval between a first recording material and a second recording material, the second recording material being a recording material to be fed immediately after the first recording material, and (ii) the fixing portion fixes the image on the first recording material while the first recording material remains oblique.

11. An image forming apparatus for forming an image on a recording material, the image forming apparatus comprising:

an image forming portion configured to form the image on the recording material;

a fixing portion including a flexible, cylindrical rotatable member and a roller in press contact with said rotatable member, said rotatable member and said roller being configured to form a fixing nip in which the recording material, on which the image is formed, is nipped and fed, the fixing portion being configured to fix the image on the recording material;

an oblique movement detecting portion configured to detect oblique movement of the recording material; and a control portion, wherein, when said oblique movement detecting portion does not detect the oblique movement of a first recording material, said control portion is configured to control an interval between a second recording material and a third recording material to be a first feeding interval, the second recording material being a recording material to be fed after the first recording material, and the third recording material being a recording material to be fed immediately after the first recording material, and wherein, when said oblique movement detecting portion detects the oblique movement of the first recording material, (i) said control portion is configured to control the interval to be a second feeding interval, the second feeding interval being longer than the first feeding interval, and (ii) the fixing portion fixes the image on the first recording material while the first recording material remains oblique.

12. An image forming apparatus for forming an image on a recording material, the image forming apparatus comprising:

an image forming portion configured to form the image on the recording material;

an accommodating portion configured to accommodate the recording material to be supplied to said image forming portion;

a feeding portion configured to feed the recording material to said image forming portion from said accommodating portion at a feeding timing;

a fixing portion including a flexible, cylindrical rotatable member and a roller in press contact with said rotatable member, said rotatable member and said roller being configured to form a fixing nip in which the recording material, on which the image is formed, is nipped and fed, the fixing portion being configured to fix the image on the recording material;

an oblique movement detecting portion configured to detect oblique movement of the recording material; and a control portion configured to control the feeding timing of said feeding portion, wherein, when said oblique movement detecting portion detects the oblique movement of the recording material, (i) said control portion controls said feeding portion to increase a feeding interval between a subsequent recording material to be fed after the recording material and a further subsequent second recording material to be fed immediately after the subsequent recording material, and (ii) the fixing portion fixes the image on the recording material while the recording material remains oblique.

13. The image forming apparatus according to claim 1, further comprising a regulating member provided with a guide portion for guiding rotation of said rotatable member from an inside surface of said rotatable member and configured to regulate a shift of said rotatable member.

14. The image forming apparatus according to claim 13, wherein in a case in which the first recording material is obliquely moved and said rotatable member is shifted to a first direction closing to said regulating member, said regulating member returns said rotatable member towards a second direction opposite to the first direction during the feeding interval.

15. The image forming apparatus according to claim 14, wherein, in a case in which the first recording material is obliquely moved and said rotatable member is shifted to a first direction closing to said regulating member, said control portion increases the feeding interval from a first feeding interval to a second feeding interval and said regulating member returns said rotatable member towards the second direction opposite to the first direction during the second feeding interval.

* * * * *